US006866491B2

(12) United States Patent
Maeng

(10) Patent No.: US 6,866,491 B2
(45) Date of Patent: Mar. 15, 2005

(54) COMPRESSOR

(76) Inventor: Hyuk-Jae Maeng, 203-1003, Keukdong APT, Backma Maeul, #739, Madoo-dong Ilsan-gu, Goyang-shi, 411-708 (KR)

( * ) Notice: Subject to any disclaimer, the term of this patent is extended or adjusted under 35 U.S.C. 154(b) by 0 days.

(21) Appl. No.: 10/484,044

(22) PCT Filed: Feb. 22, 2002

(86) PCT No.: PCT/KR02/00298

§ 371 (c)(1),
(2), (4) Date: Jan. 16, 2004

(87) PCT Pub. No.: WO03/014571

PCT Pub. Date: Feb. 20, 2003

(65) Prior Publication Data

US 2004/0191105 A1 Sep. 30, 2004

(30) Foreign Application Priority Data

Aug. 9, 2001 (KR) ..... 2001-47963

(51) Int. Cl.[7] ..... F01C 19/02

(52) U.S. Cl. ..... 418/112; 418/146; 418/255; 418/258

(58) Field of Search ..... 418/255, 258, 418/112, 146

(56) References Cited

U.S. PATENT DOCUMENTS 600,723 A * 3/1898 Johnson ..... 418/112
611,700 A * 10/1898 Miner ..... 418/112
704,638 A * 7/1902 Hodgson ..... 418/112
2,514,521 A * 7/1950 Shaff ..... 418/258

FOREIGN PATENT DOCUMENTS

JP 52016011 A * 2/1977 ..... F04C/25/02
JP 55119991 9/1980
JP 61244888 10/1986
JP 01224487 9/1989

OTHER PUBLICATIONS

English–language abstract of Japanese Patent Publication No. 01–224487, Patent Abstracts of Japan, published Sep. 7, 1989.

English–language abstract of Japanese Patent Publication No. 61–244888, Patent Abstracts of Japan, published Oct. 31, 1986.

English–language abstract of Japanese Patent Publication No. 55–119991, Patent Abstracts of Japan, published Sep. 16, 1980.

* cited by examiner

*Primary Examiner*—Theresa Trieu
(74) *Attorney, Agent, or Firm*—Cooper & Dunham LLP

(57) ABSTRACT

The present invention relates to a compressor, and more particularly, to a compressor for continuously extruding and feeding a compressing medium introduced into a compressing chamber, by means of a pressing pin member being elastically contacted with an inner circumference surface of the compressing chamber and a rotary pressing member having two wings at left and right.

3 Claims, 11 Drawing Sheets

– Prior Art –

COMPRESSOR

TECHNICAL FIELD

The present invention relates to a compressor, and more particularly to a compressor for continuously extruding and feeding a medium introduced into a compression chamber by means of a plurality of pressing pin members elastically contacting an inner circumference of the compression chamber and a rotary pressing member having two wings on both sides.

BACKGROUND ART

Generally, compressors are divided into compressors for compressing compressible fluids such as air, gas, refrigerant, etc., and hydraulic compressors for compressing and feeding incompressible fluids such as oil, water, etc., according to media to be compressed. Further, the compressors are variously divided into piston compressors, screw compressors, centrifugal compressors, scroll compressors, and so on, according to compression methods.

For example, the piston compressor conventionally compresses air, etc. by a reciprocating movement of a piston so as to generate a rotary force delivered to an engine or a motor, and feeds the compressed air to a power transmission system such as a crankshaft or a connecting rod. Herein, since much rotary force delivered to the power transmission system to change the reciprocating movement to a rectilinear motion is consumed, the piston compressor reduces a compression efficiency, and increases the generation of vibration and noise.

The recently developed scroll compressor comprises a pair of scrolls, i.e., a rotary scroll and a fixed scroll, and a plurality of variable compression chambers. The scroll compressor decreases the dimensions of the compression chambers by the rotation of the rotary scroll within the variable compression chambers, and thus compresses a media introduced into the compression chambers. Compared to the piston compressor, the scroll compressor improves a compression efficiency and reduces the generation of vibration and noise. However, since the rotary scroll has a complicated structure, the scroll compressor is difficult to manufacture.

With reference to FIG. 1, a conventional vane compressor comprises a cylinder chamber 70, a rotor 71, and vane members 72A–R. The cylinder chamber 70 compresses an introduced medium and extrudes the compressed medium in a hermetically sealed state. The rotor 71 is rotated about its eccentric axis so that an outer circumference of the rotor 71 partially contacts an inner circumference of the cylinder chamber 70. A plurality of the vane members 72A–R are radially arranged along the eccentric axis of the rotor 71, and contact the inner circumference of the cylinder chamber 70, thereby extruding the compressed medium.

A plurality of vane slots 73A–R for accommodating the corresponding vane members 72A–R are radially formed on the circumference of the rotor 71. A spring (not shown) for compressing and extending each of the vane members 72A–R is installed within the vane slots 73A–R.

Hereinafter, an operation of the aforementioned conventional vane compressor will be described in detail. When the rotor 71 is rotated, the vane members 72A–R are also rotated within the cylinder chamber 70 by the rotation of the rotor 71. Then, outer ends of the respective vane members 72A–R contact the outer circumference of the cylinder chamber 70 and are rotatably slid along the outer circumference of the cylinder chamber 70. At this time, the outer ends of the respective vane members 72A–R are elastically compressed and stretched by the springs installed between the vane members 72A–R and the vane slot 73A–R according to their contact positions with the outer circumference of the cylinder chamber 70.

For example, in case one of the vane members 72A–R has the maximum length from its outer end to its contact point with the inner circumference of the cylinder chamber 70, this member of the vane members 72A–R is maximally protruded from the corresponding slot of the vane slots 73A–R by the elastically stretched force of the spring installed in the corresponding slot of the vane slots 73A–R and firmly contacts the inner circumference of the cylinder chamber 70. On the other hand, in case one of the vane members 72A–R has the minimum length from its outer end to its contact point with the inner circumference of the cylinder chamber 70, this member of the vane members 72A–R is maximally inserted into the corresponding slot of the vane slots 73A–R by the elastically compressed force of the spring installed in the corresponding slot of the vane slots 73A–R and firmly contacts the inner circumference of the cylinder chamber 70. Therefore, the vane members 72A–R are compressed and stretched according to their positions within the cylinder chamber 70. As a result, the vane members 72A–R are pushed toward the inner circumference of the cylinder chamber 70 by the high-speed rotary force of the eccentrically rotated rotor 71 and the restoring force of the springs of the vane members 72A–R compressed and stretched according to their contact positions within the cylinder chamber 70, thereby maintaining the sealed state of the cylinder chamber 70 required to suck and compress a fluid.

As described above, when a medium is introduced into the cylinder chamber via a fluid suction section 74A or 74B, the rotor 71 eccentrically rotates. Then, the medium is compressed by sealed spaces formed between the plural vane members 72A–R and the inner circumference of the cylinder chamber 70 and extruded to the outside via a fluid exhaustion section 74D.

However, since the outer ends of the vane members 72A–R of the aforementioned conventional compressor are comparatively flat, there is a gap A between the outer end of the vane member and the inner circumference of the cylinder chamber 70. The highly compressed fluid pushes the vane members 72A–R in the direction to the eccentric axis of the rotor 71 via the gap A within the cylinder chamber 70. Therefore, the hermetically sealed state between the vane members 72A–R and the inner circumference of the cylinder chamber 70 maintained by the high-speed rotary force of the eccentrically rotated rotor 71 and the restoring force of the springs of the vane members 72A–R according to their contact positions with the inner circumference of the cylinder chamber is broken, and thus the compressed fluid is leaked via the gaps A of the vane members 72A–R.

Moreover, since the aforementioned compressor comprises a plurality of the vane members 72A–R installed along the circumference of the rotor 71 so as to maintain the hermetically sealed state of the cylinder chamber 70, the dimensions of spaces for compressing the fluid within the cylinder chamber 70 is reduced by the dimensions occupied by the vane members 72A–R, and thus the compression efficiency of the compressor is deteriorated.

DISCLOSURE OF THE INVENTION

Therefore, the present invention has been made in view of the above problems, and it is an object of the present invention to provide a compressor comprising a plurality of pressing pin members elastically contacting an inner circumference of a compression chamber and a rotary pressing member having two wings on both sides, thereby assuring the sufficient dimension of a compression space and improving a compression efficiency.

It is another object of the present invention to provide a compressor for maximally compressing a medium by variably changing the dimension of the compression space when the pressing pin members are rotated and contact the inner circumference of the compression chamber, thereby compressing the medium using the rotary motion of a rotary axis and preventing damage to the compressor.

In accordance with the present invention, the above and other objects can be accomplished by the provision of a compressor for compressing a medium using a rotary pressing member eccentrically rotated within a cylinder, comprising:

a cylinder-shaped compression chamber for compressing the introduced medium under a sealed condition within its variable compression space and extruding the compressed medium;

a rotor including a plurality of pressing pins elastically contacting an inner circumference of the compression chamber so as to maintain the sealed condition of the compression chamber, and integrally formed with an eccentric rotary axis; and a rotary pressing member including two wings at its right and left sides so as to penetrate the center of the rotor and contact the inner circumference of the compression chamber.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be described in detail with reference to the accompanying drawings.

Figure 1:
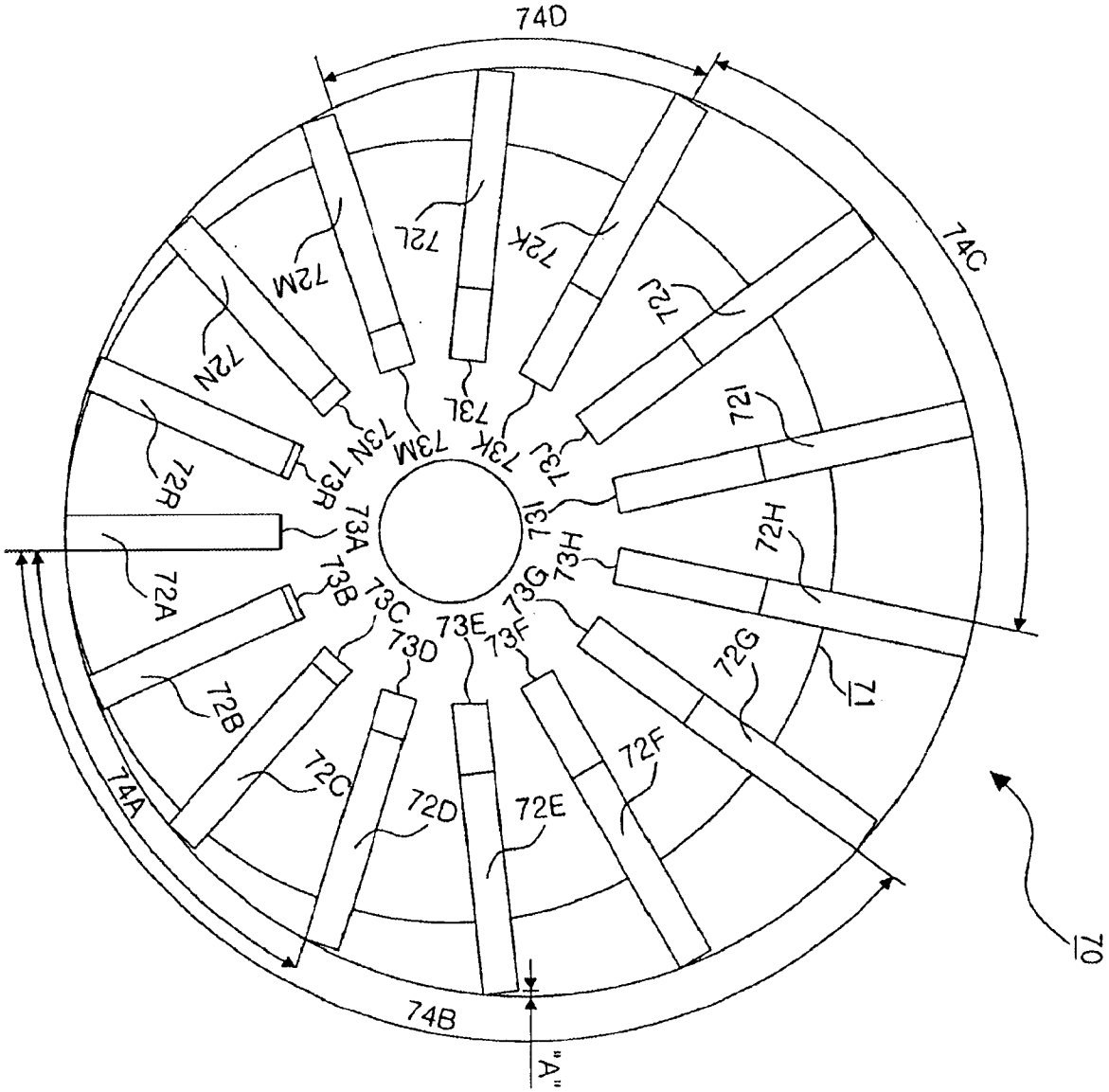
FIG. 1 is a schematic view illustrating an example of conventional compressors.
Figure 2:
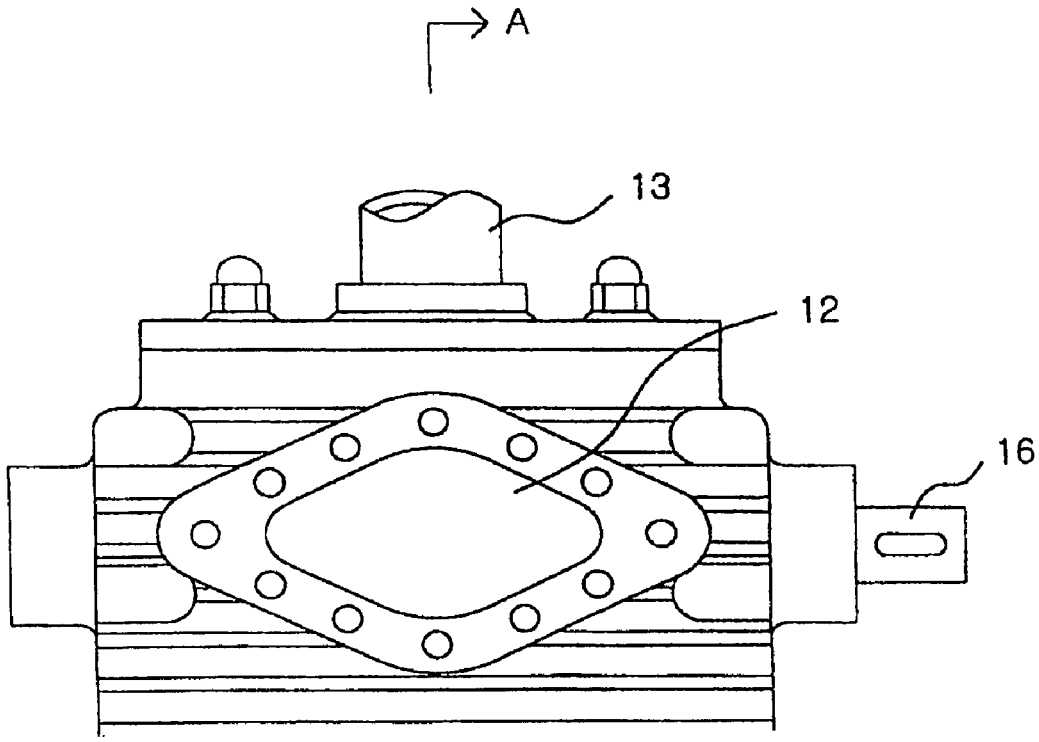
FIG. 2 is a front view of a compressor in accordance with an embodiment of the present invention.

In accordance with the present invention, as shown in FIG. 2, a main body 11 of a compressor is formed as a cylinder. An inlet 12 and an outlet 13 being almost perpendicular to the inlet 12 are formed on the outer surface of the main body 11. A compression chamber 14 formed as a cylinder for connecting the inlet 12 to the outlet 13 is formed in the main body 11, and a rotary axis 16 with both ends connected to opposite ends of the main body 11 is installed within the main body 11 so as to be eccentric with the compression chamber 14.

Hereinafter, with reference to FIG. 3, the compressor of the present invention will be described in more detail. The compressor comprises the cylinder-shaped compression chamber 14, a rotor 21, and a rotary pressing member 32. The compression chamber 14 compresses the introduced medium under a sealed condition and extrudes the compressed medium within its variable compression spaces. The rotor 21 includes a plurality of pressing pins 24 elastically contacting an inner circumference of the compression chamber 14 so as to maintain the sealed condition of the compression chamber 14, and integrally formed with an eccentric rotary axis 16. The rotary pressing member 32 includes two wings on both sides so as to penetrate the center of the rotor 21 and contact the inner circumference of the compression chamber 14.

As shown in FIGS. 4 to 8, a plurality of pressing pin holding indentations 22 are formed on an outer circumference of the rotor 21, and a through hole 31 goes through the body of the rotor 21. The rotary pressing member 32 is inserted into the through hole 31 of the rotor 21.

Herein, the rotary pressing member 32 includes two wings. A plurality of spring holding grooves 33 are formed on inner ends of the two wings so as to be opposite to each other, and a spring 34 is provided on each groove 33.

A check valve 43 is installed in the outlet 13 of the main body 11.

Each of both ends of the rotary pressing member 32 movably inserted into the through hole 31 of the rotor 21 includes a protrusion 32-1 having a rounded tip 32-2 shaped as an arc at its end.

A plurality of the pressing pin holding indentations 22 having a L-shape are formed on the outer circumference of the rotor 21. A rotor-side fixing rod holding recess 22-1 is formed on the inner wall of the pressing pin holding indentation 22. Each of a plurality of pressing pins 24 is inserted into the corresponding one of the pressing pin holding indentations 22.

A pin-side fixing rod holding recess 24-1 is formed on one side wall of the pressing pin 24. A fixing rod 29 is inserted into a space between the rotor-side fixing rod holding recess 22-1 and the pin-side fixing rod holding recess 24-1, and the pressing pin 24 is inserted into the pressing pin holding indentation 22. A spring 23 is interposed between the holding indentation 22 and the pressing pin 24 so as to supply an elastic force.

Figure 9:
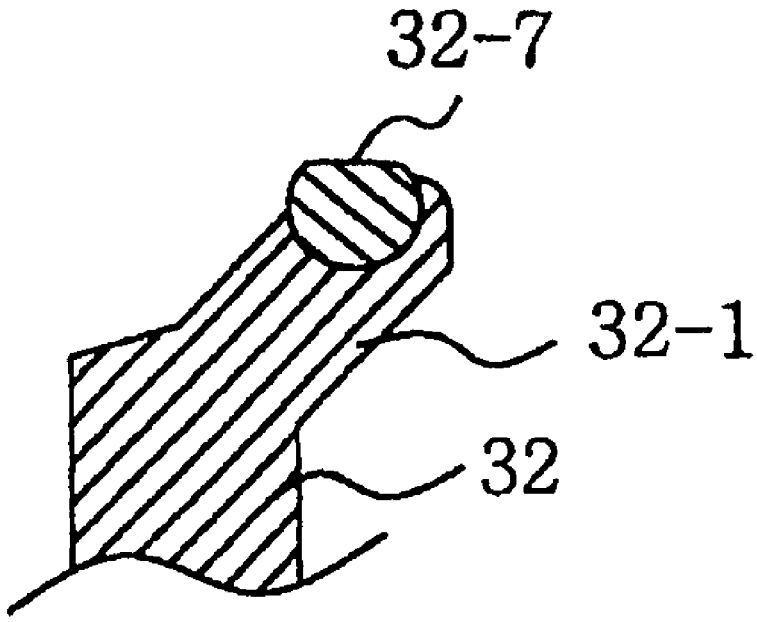
FIG. 9 is a partial cross-sectional view showing an outer end of a rotary pressing member, where a round bar is inserted thereto, in accordance with another embodiment of the present invention.
Figure 10:
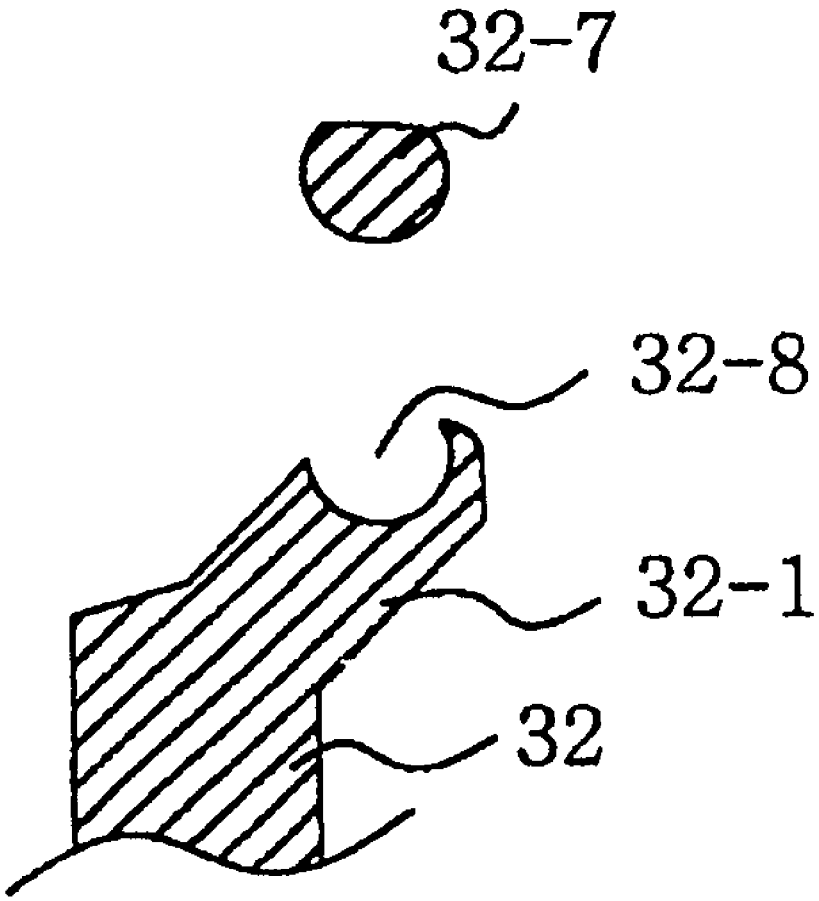
FIG. 10 is a partial cross-sectional view showing the outer end of the rotary pressing member, where the round bar is removed therefrom, in accordance with another embodiment of the present invention.

In accordance with another embodiment of the present invention, as shown in FIGS. 9 and 10, a semicircle-shaped recess 32-8 is formed on the end of the rotary pressing member 32, and a round bar 32-7 is inserted into the recess 32-8.

Hereinafter, an assembly of the compressor of the present invention will be described in detail. The cylinder-shaped compression chamber 14 is installed within the main body 11, and the both ends of the rotary axis 16 are respectively installed on both ends of the compression chamber 14 so that the rotary axis 16 is rotatable. The rotor 21 is installed on the center of the rotary axis 16 so as to be integrally formed with the rotary axis 13, and a plurality of the pressing pins 24 are inserted into the outer circumference of the rotor 21. As described above, the rotary axis 16 integrally formed with the rotor 21 having a plurality of the pressing pins 24 inserted thereinto is eccentrically installed in the cylinder-shaped compression chamber 14. Herein, since the rotary axis 16 is eccentrically installed in the compression chamber 14, the plural pressing pins 24 protruding from the surface of the rotor 21 elastically contact a designated portion of the inner circumference of the cylinder-shaped compression chamber 14.

The designated portion of the inner circumference of the cylinder-shaped compression chamber has an indented arc surface 15 so that the pressing pins 24 of the rotor 21 contact the indented arc surface 15 and are slid along the indented arc surface 15.

The rotor 21 integrally formed with the rotary axis 16 includes the through hole 31 penetrating its center, and the rotary pressing member 32 including two wings with a plurality of the springs 34 is inserted into the through hole 31.

As the width of the rotary pressing member 32 is constricted or stretched by the elastic force of the plural springs 34 inserted thereinto, when the rotor 21 is rotated, the outer ends of the rotary pressing member 32 are rotated and contact the inner circumference of the cylinder-shaped compression chamber 14.

For example, in the rotary pressing member 32 including two wings, the spring holding grooves 33 for receiving the corresponding springs 34 are formed on the inner ends of the two wings contacting each other. The contact surfaces of the inner ends of the two wings are inclined so as to be engaged with each other.

In case that the inlet 12 and the outlet 13 installed on the outer surface of the main body 11 are almost perpendicular to each other, the check valve 43 including a spring and a valve tool is installed within the outlet 13.

The spring 23 such as a coil spring or a plate spring is installed on the inner wall of the pressing pin 24 inserted into the pressing pin holding indentation 22 formed along the outer circumference of the rotor 21 so that the pressing pin 24 is intruded into and protruded from the outer surface of the rotor 21. The pressing pin holding indentation 22 has a L-shaped cross-section, and includes the rotor-side fixing rod holding recess 22-1 formed on its inner wall. The fixing rod 29 is inserted into the pin-side fixing rod holding recess 24-1, and then the pressing pin 24 is inserted into the pressing pin holding indentation 22.

The pressing pin 24 inserted into the pressing pin holding indentation 22 of the rotor 21 is supplied with an elastic force for protruding the pressing pin 24 from the rotor 21 by the spring 23. Herein, the fixing rod 29 inserted into a gap between the pin-side fixing rod holding recess 24-1 and the rotor-side fixing rod holding recess 22-1 prevents the pressing pin 24 from separating from the pressing pin holding indentation 22.

The pressing pin 24 is movably inserted into the pressing pin holding indentation 22 by a play between the pin-side fixing rod holding recess 24-1 and the rotor-side fixing rod holding recess 22-1.

Therefore, when the pressing pin 24 is inserted into the pressing pin holding indentation 22, the fixing state of the pressing pin 24 within the rotor 21 is maintained and simultaneously the pressing pin 24 closely contacts the indented arc surface 15 of the cylindrical-shaped compression chamber 14, thereby preventing the medium compressed by the rotary pressing member 32 from flowing backward in the direction of the inlet 12 instead of the outlet 13.

The aforementioned pressing pins 24 are supplied with the elastic force from the springs 23 and press the indented air surface 15, thereby maintaining the sealed state of the compression chamber 14.

A pressure generated by the rotation of the rotor 21 acts on the pressing pins 24 via a gap between the pressing pin 24 and the holding indentation 22, thereby pushing the pressing pin 24 backward together with the spring 23 and bringing the pressing pin 24 in contact with the inner circumference of the cylinder chamber 14. Simultaneously, the rotary pressing member 32 also prevents the leakage of the pressure into the inlet 12.

In accordance with the present invention, when the rotary axis 16 is once rotated, the rotary pressing member 32 twice compresses the medium introduced into the compression chamber 14 and the rotation action and the compression action are simultaneously achieved. Therefore, the compressor of the present invention reduces the generation of noise and improves the compression efficiency.

That is, in case the rotary axis 16 is connected to a motor axis or an engine axis and then rotated, the plural pressing pins 24 inserted into the outer circumference of the rotor 21 contact the indented arc surface 15 formed on the inner circumference of the compression chamber 14, and the rotor 21 is rotated. The rotary pressing member 32 inserted into the through hole 31 of the rotor 21 contacts the inner circumference of the cylinder-shaped compression chamber 14 and then is rotated along the inner circumference of the cylinder-shaped compression chamber 14.

In other words, a plurality of the springs 34 are inserted into the inner ends of the two wings of the rotary pressing member 32 penetrating the rotor 21. Herein, the rotary pressing member 32 including the two wings supplies an outwardly stretched force toward the inner circumference of the compression chamber 14 by the elastic force of the springs 34, and is outwardly stretched within the through hole 31 of the rotor 21, and is rotated by the rotation of the rotor 21. Since the rotary axis 16 is eccentrically installed in the cylinder-shaped compression chamber 14, the outer ends of the two wings of the rotary pressing member 32 inserted into the rotor 21 contact the inner circumference of the compression chamber 14, and simultaneously the rotary pressing member 32 is rotated.

As shown in FIGS. 9 and 10, the arc-shaped tip 32-2 formed on the protrusion 32-1 of the rotary pressing member 32 contacts the inner circumference of the main body 11. Since the protrusion 32-1 protrudes from the surface of the rotary pressing member 32, the maximum compressive force acts on the protrusion 32-1 formed on the ends of the rotary pressing member 32 when the rotary pressing member 32 is rotated by the rotor 21.

Therefore, since the compressive force of the rotary pressing member 21 is supplied in a circumferential direction of the main body 11 by the protrusion 32-1, i.e., acting on the arc-shaped tip 32-2 formed on the end of the protrusion 32-1, the arc-shaped tip 32-2 presses and contacts the inner circumference of the compression chamber 14, thereby maintaining the sealed condition between the rotary pressing member 32 and the inner circumference of the main body 11.

In case the rotary axis 16 rotates at high speed and makes the rotary pressing member 32 to be rotated at high speed, the pressure is increased and the rotary pressing member 32 more firmly contacts the inner circumference of the compression chamber 14. Thereby, the leakage of the pressure between the compression chamber 14 and the rotary pressing member 32 is prevented.

Figure 11:
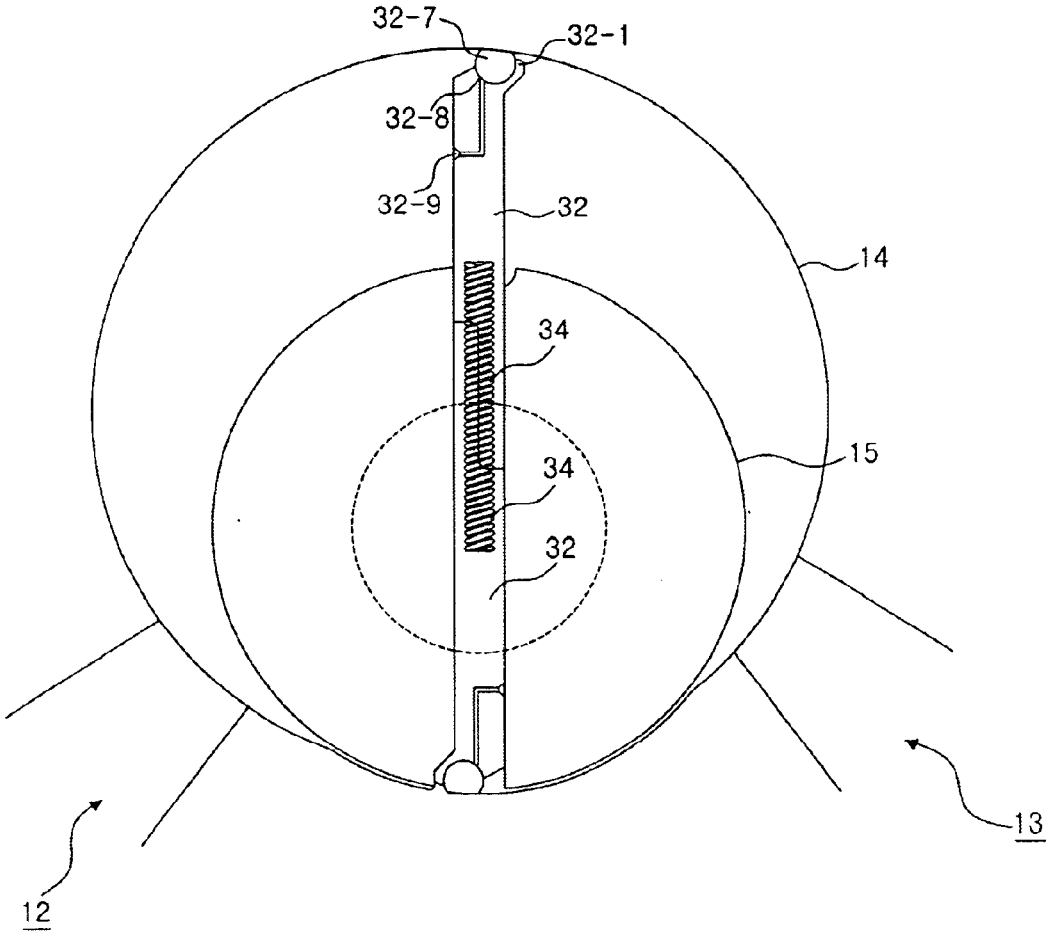
FIG. 11 is a schematic view of a protrusion in accordance with yet another embodiment of the present invention.

As shown in FIG. 11, in accordance with another embodiment of the present invention, a ball holding or semicircle-shaped recess 32-8 for receiving a sphere shaped ball or round bar 32-7 is formed on the protrusion 32-1, and a lubricant supply unit 32-9 for supplying a lubricant, connected to the ball holding or semicircle-shaped recess 32-8 via a tube, is installed on both ends of the rotary pressing member 32.

Herein, the lubricant supply unit 32-9 supplies the lubricant to the ball or round bar 32-7, thereby lubricating the rotation of the rotary pressing member 32 when the ball or round bar 32-7 contacts the inner circumference of the compression chamber 14.

Hereinafter, an operation and function of the compressor of the present invention will be described in detail.

In case the rotor 21 rotates in the clockwise direction (shown by an arrow of the drawings), the rotary pressing member 32 inserted into the rotor 21 simultaneously rotates along the inner circumference of the cylinder-shaped compression chamber 14 in the clockwise direction. Herein, the medium introduced into the compression chamber via the inlet 12 of the main body 11 flows in the clockwise direction by the rotation of the rotary pressing member 32 and is compressed by the operation of the rotary pressing member 32, and the compressed medium is extruded to the outside via the outlet 13.

That is, in case the rotary pressing member 32 rotates in the clockwise direction, the medium is sucked into one space between one side of the rotary pressing member 32 and the inner circumference of the compression chamber 14 by the inner pressure of the compression chamber 14 via the inlet 12 installed adjacent to one side of the rotary pressing member 32 and compressed by the rotation of the pressing member 32. Simultaneously, the medium already located between the other space between the other side of the rotary pressing member 32 and the inner circumference of the compression chamber 14 is also compressed by the rotation of the pressing member 32, and then extruded to the outside via the outlet 13.

Figure 3:
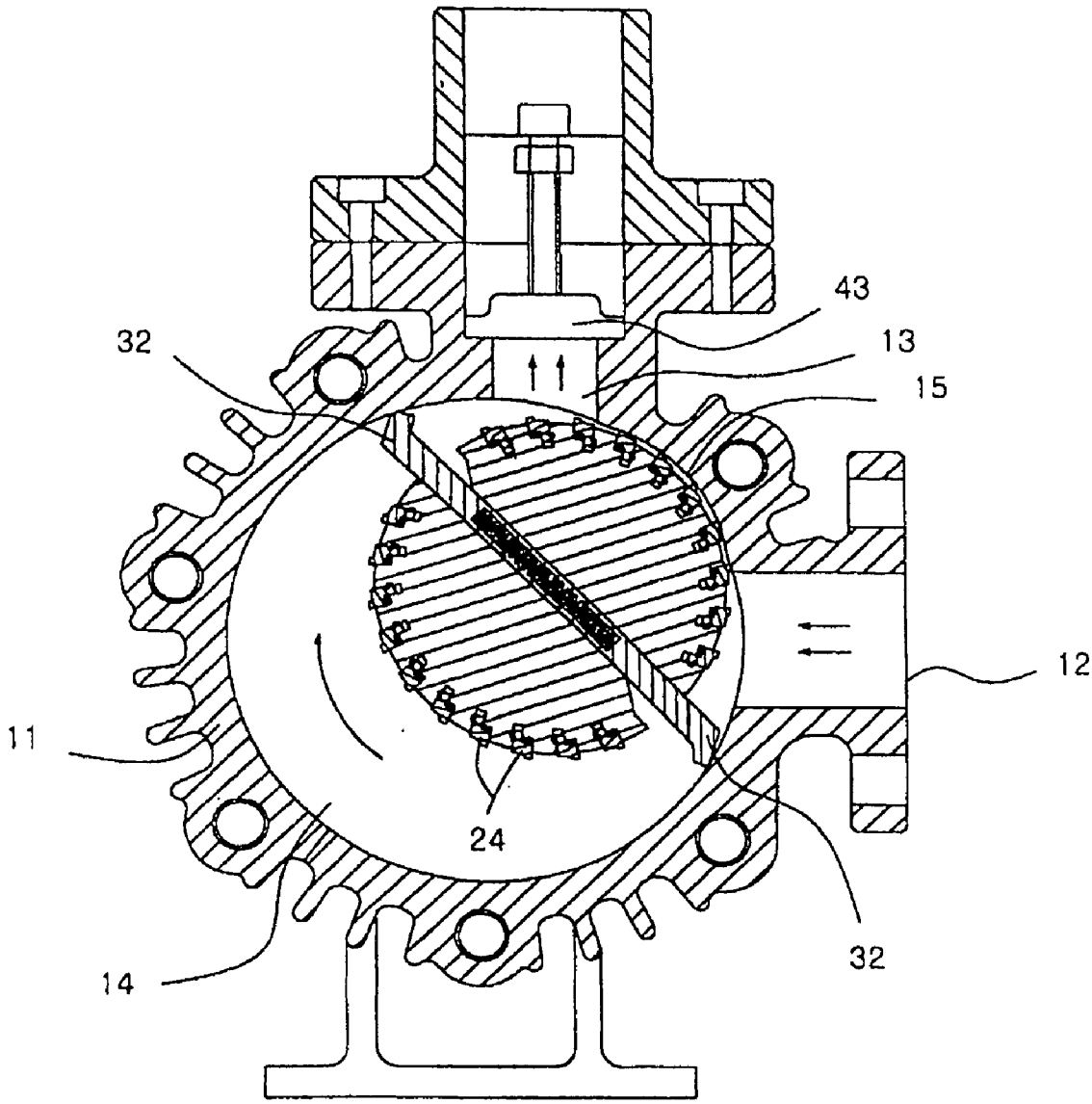
FIG. 3 is a cross-sectional view taken along the line A—A of FIG. 2 showing suction and compression steps in accordance with the present invention.
Figure 4:
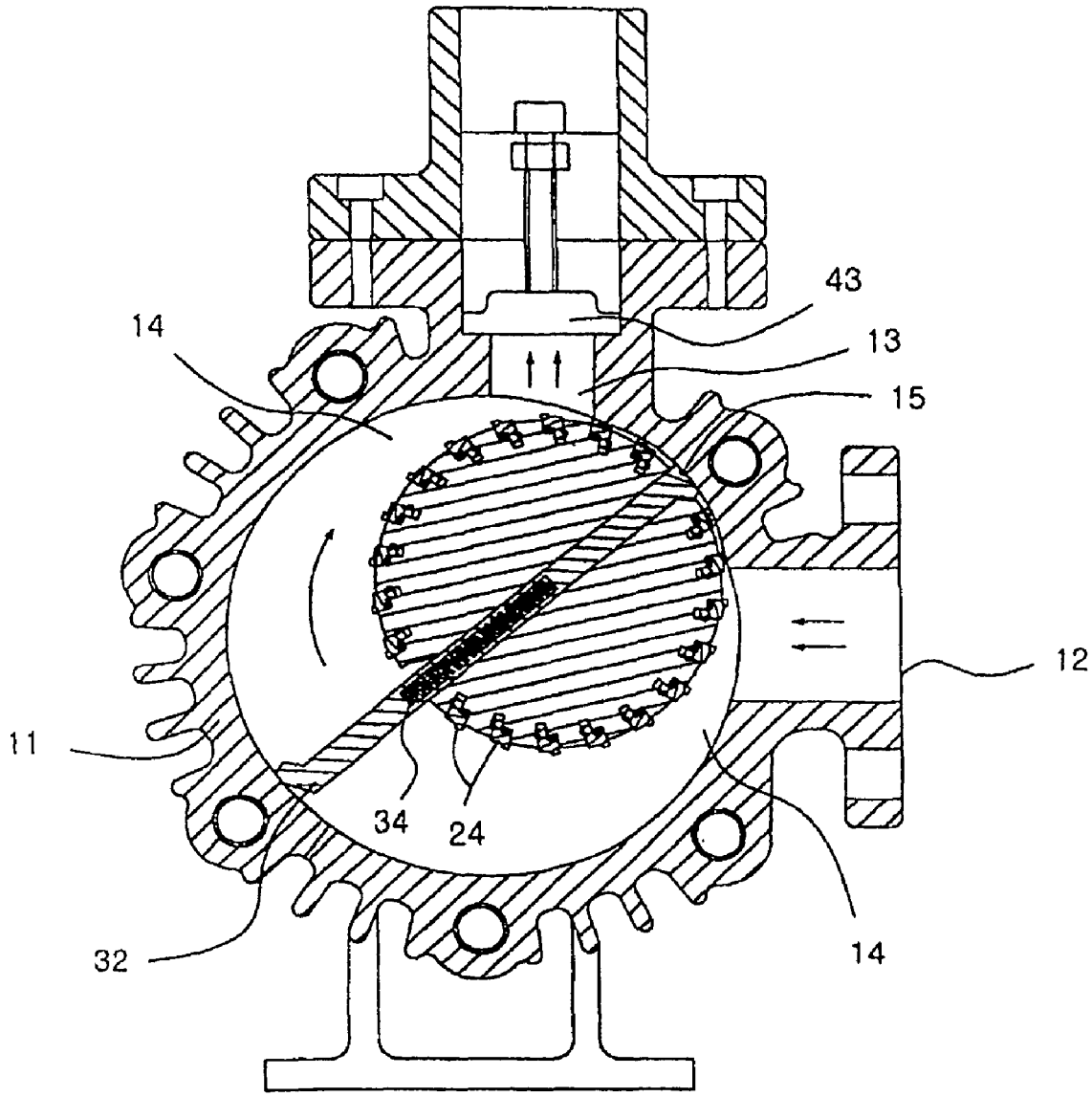
FIG. 4 is a cross-sectional view taken along the line A—A of FIG. 2 showing compression and exhaustion steps in accordance with the present invention.
Figure 5:
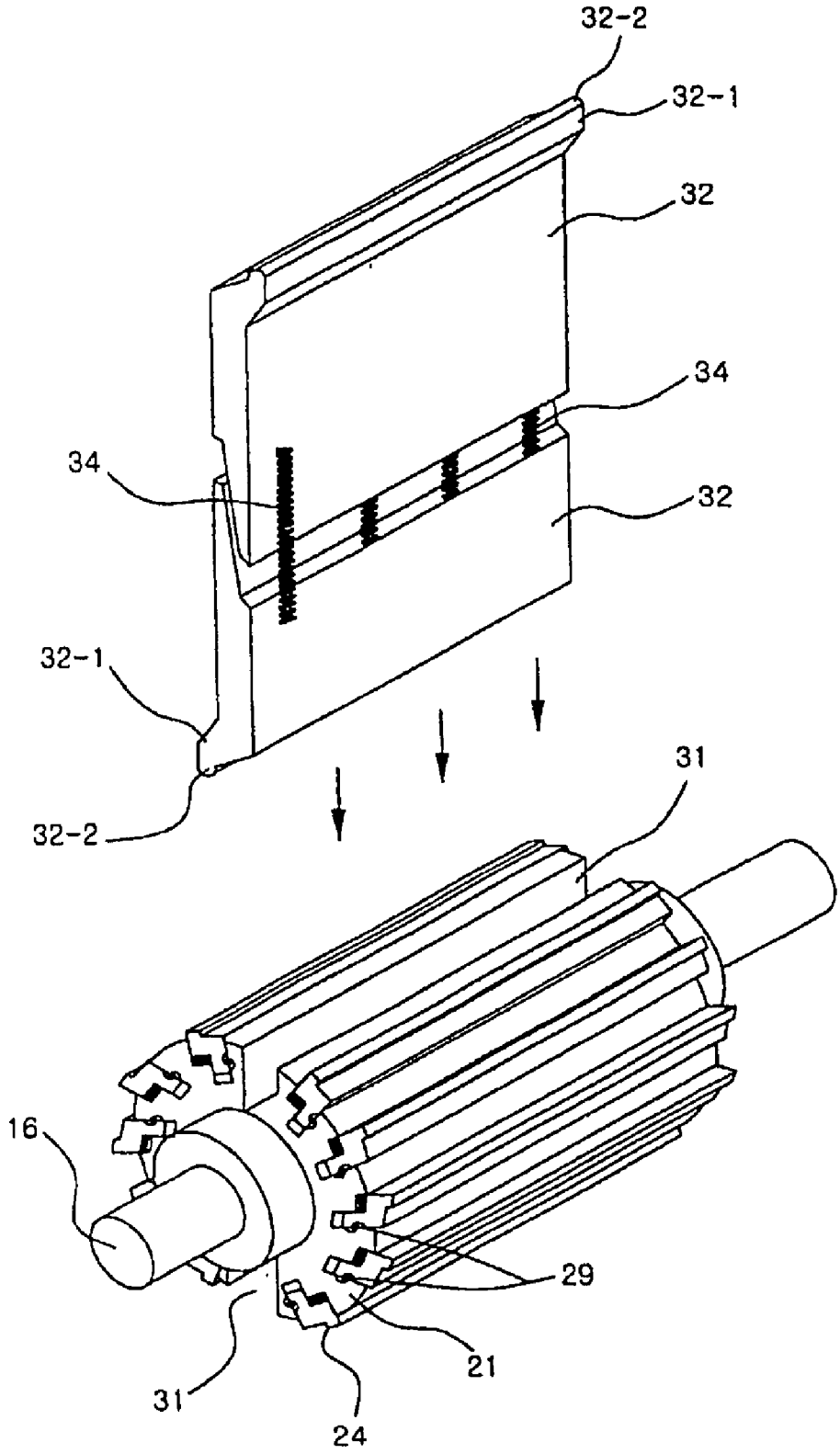
FIG. 5 is an exploded perspective view of a rotor and a rotary pressing member in accordance with the present invention.
Figure 6:
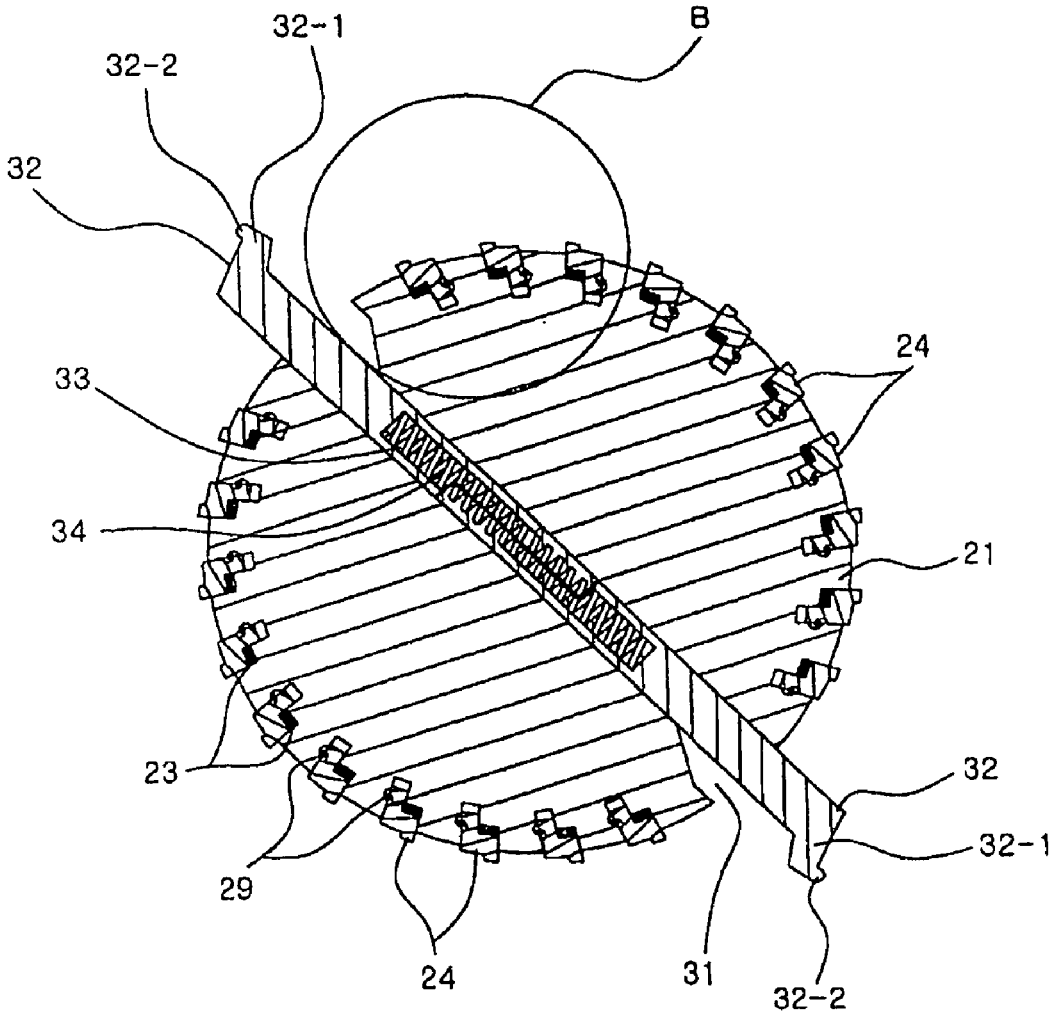
FIG. 6 is a cross-sectional view of the rotor and the rotary pressing member in accordance with the present invention.
Figure 7:
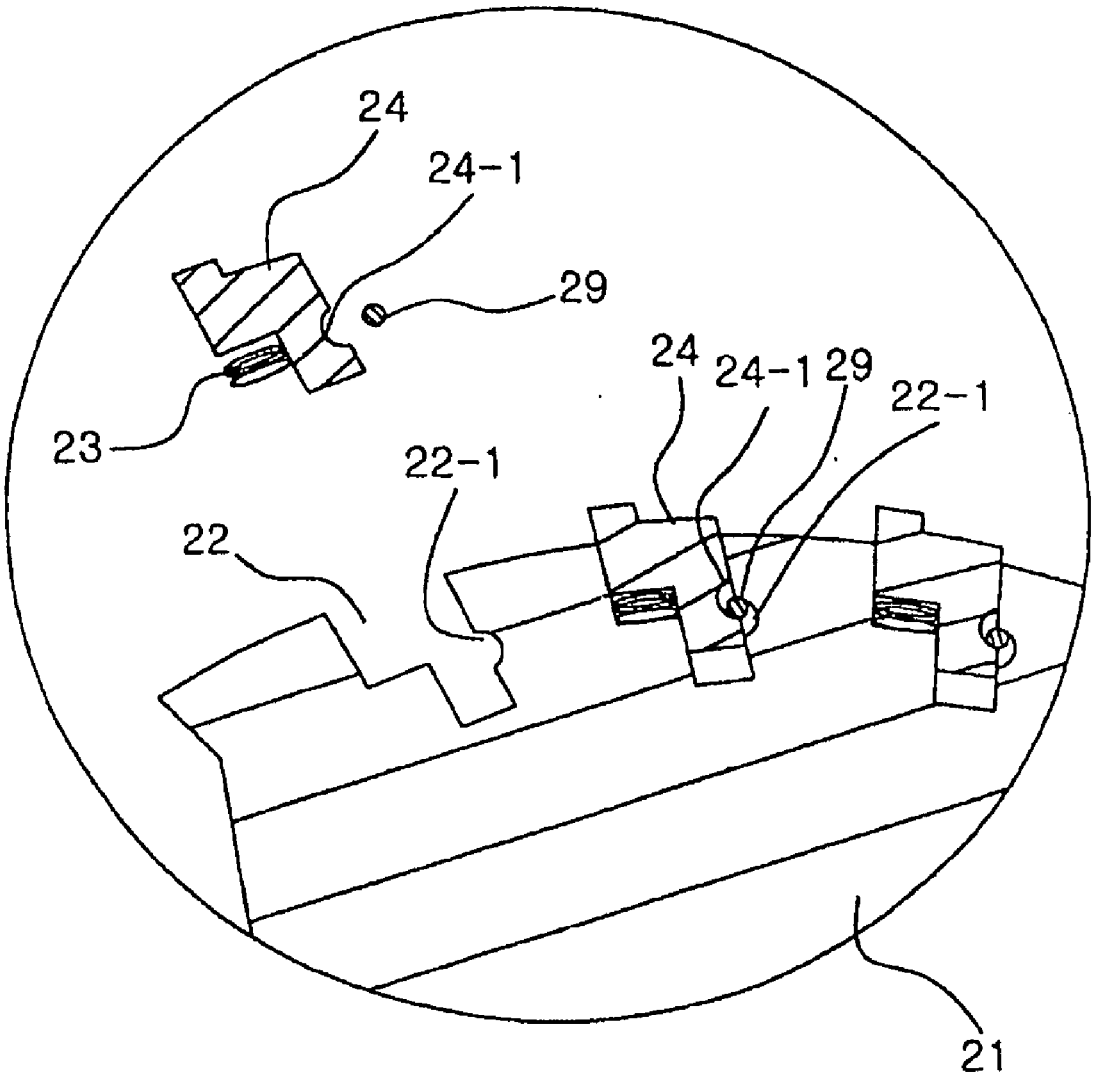
FIG. 7 is an enlarged cross-sectional view of the "B" portion of FIG. 6.
Figure 8:
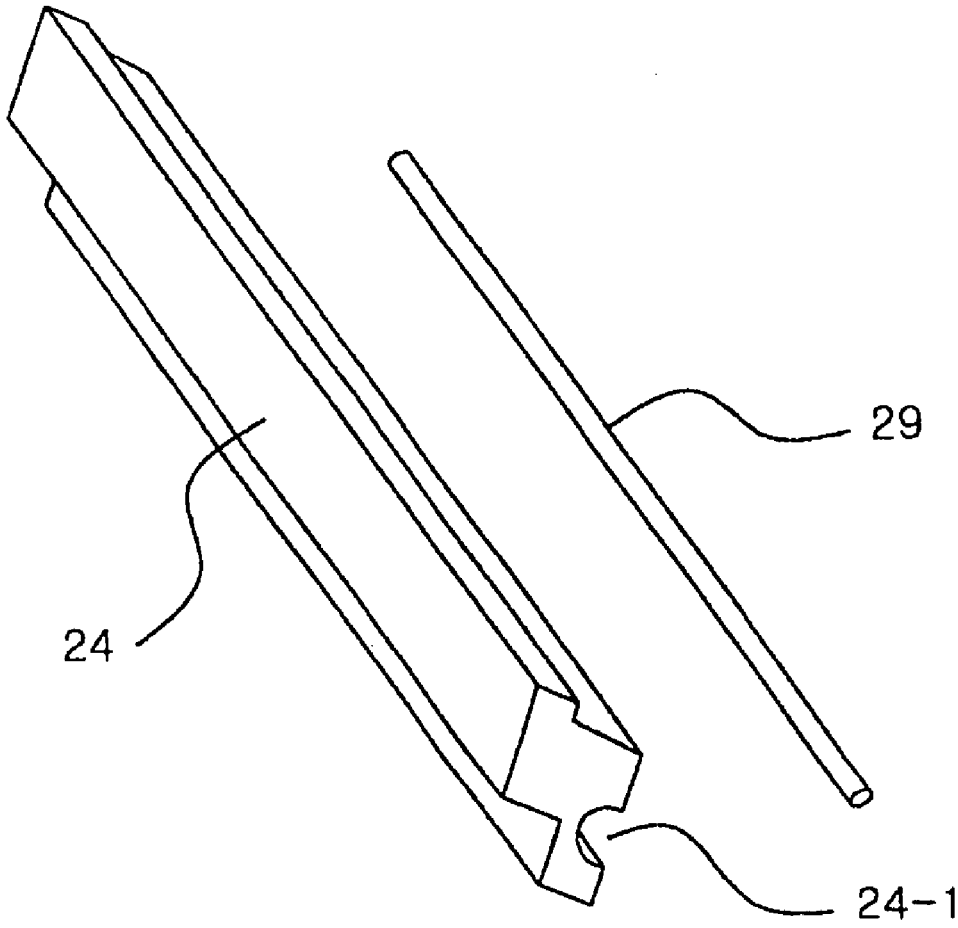
FIG. 8 is a perspective view of a pressing pin and a fixing rod for fixing the pressing pin.

Herein, FIG. 3 shows the maximally stretched state of the interval between the two wings of the rotary pressing member, and FIG. 4 shows the minimally constricted state of the interval between the two wings of the rotary pressing member.

When the rotary pressing member 32 contacting the inner circumference of the cylinder-shaped compression chamber 14 is rotated by the rotation of the rotor 21, the medium is sucked via the inlet 12 into one space formed between one side of the rotary pressing member 32 and the inner circumference of the compression chamber 14, and simultaneously the already sucked medium contained by the other space formed between the other side of the rotary pressing member 32 and the inner circumference of the compression chamber 14 is compressed and extruded to the outside via the outlet 13. That is, the compressor of the present invention simultaneously performs the suction and the compression of medium.

Herein, since simultaneously with the aforementioned operation, the rotor 21 integrally formed with the rotary axis 16 eccentrically installed in the compression chamber 14 and including a plurality of the pressing pins 24 contacts the indented arc surface 15 disposed between the inlet 12 and outlet 13 on the inner circumference of the compression chamber 14 and is rotated, the medium introduced into the compression chamber 14 via the inlet 12 does not flow toward the outlet 13. Further, the rotary pressing member 32 contacting the inner circumference of the compression chamber 14 and rotating variably changes the dimensions of two compression, thereby compressing the medium introduced into each space of the compression chamber 14 and transferring the compressed medium to the outlet 13.

The inner ends of the both wings of the rotary pressing member 32 contacting the inner circumference of the compression chamber 14 are rounded so as to minimize friction generated therebetween.

When the rounded inner end of one wing is worn away by the friction, it is possible to replace only the worn wing with a new one. The rotary pressing member 32 includes the semicircle-shaped recesses 32-8 formed on its outer ends and the round bars 32-7 inserted into the recesses 32-8. Therefore, when the round bar 32-7 is worn away due to its use for a long time, since only the round bar 32-7 can be independently replaced with a new one, the lift span of the rotary pressing member 32 is elongated.

The inverse current of the compressed medium passing though the outlet 13 is prevented by the check valve 43 including the spring and the valve tool installed within the outlet 13.

In accordance with the present invention, the compressor can compresses and feed compressible fluids such as air, and feed incompressible fluids such as water, oil, etc.

Further, the rotary pressing member 32 inserted into the through hole 31 of the rotor 21 integrally formed with the rotary axis 16 is constricted or stretched by the springs 34 within the through hole 31 so as to variably change its length according to the variable change of the dimensions of two spaces respectively formed between one side of the rotary pressing member 32 and the inner circumference of the compression chamber 14 and between the other side of the rotary pressing member 32 and the inner circumference of the compression chamber 14, and simultaneously contacts the inner circumference of the compression chamber 14. Therefore, the compressor of the present invention continuously performs the compression step of the medium introduced into the compression chamber 14 via the inlet 12, the feed step of the compressed medium to the outlet 13, and the extrusion step of the fed medium to the outside via the outlet 13.

INDUSTRIAL APPLICABILITY

As apparent from the above description, the present invention provides a compressor comprising a rotary pressing member having two wings and a plurality of pressing pins contacting the inner circumference of a cylinder-shaped compression chamber, in which the rotary pressing member contacts the inner circumference of the compression chamber and is rotated along the inner circumference of the compression chamber by variably changing the width of the rotary pressing member, thereby compressing and feeding a medium introduced into the compression chamber two times by the variable change of the dimensions of two spaces within the compression chamber, when a rotor rotates one time. Therefore, the compressor of the present invention achieves the maximum compression efficiency and reduces the generation of noise and vibration.

Particularly, the compressor of the present invention may be used as a vacuum pump for sucking air so as to generate a vacuum. Further, the compressor of the present invention performs two rounds of the compression step by one round of the rotation of a rotary axis regardless of the rotational speed of the rotor by the rotation of the rotary axis.

Moreover, the compressor of the present invention achieves a precise compression ratio of the introduced medium according to the rotary force of the rotary axis, and minimizes a compression loss, thereby being used as a vacuum pump for sucking air so as to generate a vacuum.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A compressor for compressing a medium using a rotary pressing member eccentrically rotated within a cylinder, comprising:

a cylinder-shaped compression chamber for compressing the introduced medium under a sealed condition within its variable compression space and extruding the compressed medium;

a rotor including a plurality of pressing pins elastically contacting an inner circumference of the compression chamber so as to maintain the sealed condition of the compression chamber, and integrally formed with an eccentric rotary axis; and a rotary pressing member including two wings at its right and left sides so as to penetrate the center of the rotor and contact the inner circumference of the compression chamber;

wherein the rotary pressing member includes a protrusion with a designated length protruding from each of outer ends of the two wings contacting the inner circumference of the compression chamber; and wherein the protrusion includes a semicircle-shaped recess for receiving a round bar on its end.

2. A compressor as set forth in claim 1, wherein a lubricant supply unit for supplying a lubricant to the semicircle-shaped recess is installed on both ends of the rotary pressing member.

3. A compressor as set forth in claim 1, wherein the rotor includes a plurality of pressing pin holding indentations formed on an outer circumference of the rotor; and wherein a fixing rod holding recess for receiving a fixing rod is formed on the pressing pin holding indentation.

* * * * *